US006056387A

United States Patent [19]

Kaneko

[11] Patent Number: 6,056,387

[45] **Date of Patent: *May 2, 2000**

[54] CLEANING OF INK JET PRINTHEAD SURFACE RESPONSIVE TO AN OPTICALLY SENSED CONDITION THEREOF

[75] Inventor: Mineo Kaneko, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/896,621

[22] Filed: Jul. 18, 1997

Related U.S. Application Data

[63] Continuation of application No. 08/395,905, Feb. 28, 1995, abandoned.

[30] Foreign Application Priority Data

Mar. 10, 1994 [JP] Japan ..... 6-066802

[51] Int. Cl.[7] ..... B41J 2/165

[52] U.S. Cl. ..... 347/23; 347/33

[58] Field of Search ..... 347/5, 19, 23, 347/30, 33, 35

[56] References Cited

U.S. PATENT DOCUMENTS

| | | | |
|---|---|---|---|
| 4,951,066 | 8/1990 | Terasawa et al. | 347/33 |
| 4,970,534 | 11/1990 | Terasawa et al. | 346/140 R |
| 5,182,582 | 1/1993 | Okamura | 347/33 |
| 5,298,926 | 3/1994 | Fukushima et al. | 347/34 |
| 5,355,158 | 10/1994 | Inada et al. | 347/4 |

FOREIGN PATENT DOCUMENTS

| | | | |
|---|---|---|---|
| 452157 | 10/1991 | European Pat. Off. | 347/19 |
| 3244112 | 5/1984 | Germany | 347/19 |
| 54-145561 | 11/1979 | Japan . | |
| 58-81170 | 5/1983 | Japan . | |
| 60-122160 | 6/1985 | Japan . | |
| 1-308638 | 12/1989 | Japan . | |
| 2-194967 | 8/1990 | Japan | 347/23 |
| 4-27551 | 1/1992 | Japan . | |
| 4-65250 | 3/1992 | Japan | 347/19 |
| 5-8402 | 1/1993 | Japan | 347/33 |

*Primary Examiner*—Benjamin R. Fuller
*Assistant Examiner*—Michael S Brooke
*Attorney, Agent, or Firm*—Fitzpatrick, Cella, Harper & Scinto

[57] ABSTRACT

A cleaning method for an ink jet recording apparatus includes a first cleaning step and a second cleaning step. In the first cleaning step, an ink discharge port surface of the apparatus is cleaned in accordance with a degree of reflection of the surface, where the reflection rate is detected by an optical sensor included in the recording apparatus. In the second cleaning step, a cleaning of the surface which is different from the first cleaning is performed in accordance with an output of the optical sensor.

45 Claims, 8 Drawing Sheets

CLEANING OF INK JET PRINTHEAD SURFACE RESPONSIVE TO AN OPTICALLY SENSED CONDITION THEREOF

This application is a continuation of application Ser. No. 08/395,905 filed Feb. 28, 1995, now abandoned.

BACKGROUND OF THE INVENTION

1. Field of the Invention

The present invention relates to an ink jet recording apparatus for recording by discharging ink from recording means to a recording material.

2. Related Background Art

A recording apparatus provided with the function of a printer, copying machine, facsimile or the like or a recording apparatus used as an output equipment for a complex machine or a work station including a computer, a wordprocessor, and the like, is structured to record images (including characters, symbols, and others) on a recording material (recording medium) such as a sheet or a thin plastic board (OHP or the like). Such recording apparatuses can be divided into those of an ink jet type, wire-dot type, thermosensitive type, thermal transfer type, laser beam type in accordance with to the recording system of recording means to be used.

A recording apparatus of a serial type adopts a recording method where its main scan is performed in the direction intersecting the feeding direction of a recording material (that is, the subscanning direction). In this apparatus, after a recording material is set at a predetermined recording position, images (including characters, symbols, and others) are recorded by recording means mounted on a carriage movable along the recording material (that is, the main scanning). Then after the completion of one-line portion of an image, the sheet is fed (subscanned) for a predetermined amount, thus recording the next line portion of the image (main scanning) subsequently. By repeating this operation, the image is recorded in a desired area of the recording material. On the other hand, in a recording apparatus of a line type, the recording is performed only by subscanning where the recording material is fed. In this apparatus, a recording material is set at a predetermined recording position, and then, a sheet feed is performed for a predetermined amount (that is, the pitch feeding) while the recording of a one-line portion is being made continuously altogether. In this way, the image is recorded on the entire area of the recording material.

Of these types, those of an ink jet type (ink jet recording apparatuses) record by discharging ink from recording means (recording head) onto a recording material, making it possible to provide compact recording means easily so that highly precise images can be recording at high speeds. With this type, it is also possible to record on an ordinary sheet without any particular treatments, hence lowering its running cost. Being non-impact, this type makes less noises besides a remarkable advantage that many different colors of ink can be used for recording color images without difficulty. Particularly, in a recording apparatus of a line type using a line type recording means where many numbers of discharge ports are arranged in the width direction of a sheet, it is possible to provide a higher speed recording.

Especially, recording means (recording head) of an ink jet type which discharges ink by utilizing thermal energy can be fabricated with ease to provide the one in which liquid passages (discharge ports) are arranged in a high density by the film formation of electro-thermal transducers, electrodes, walls of liquid paths, and a ceiling on a base board through etching, deposition, sputtering, and some other semiconductor fabrication processes. This makes it possible to implement manufacturing the recording means more compactly. Also, with the utilization of such known advantages of the IC technologies and micro machining techniques, it becomes easier to elongate the recording means or effectuate its surfacing (two-dimensional arrangement), and also, to make it fully multiple and highly densified when it is assembled.

In general, an ink jet recording apparatus of a serial type comprises means for recording (recording head); a carriage which travels (main scans) with the recording means mounted thereon and its driving system; a platen for holding and feeding a recording material and a feeding (sheet feed) system; and a system for recovering discharge for maintaining and recovering the ink discharge performance of the recording means.

In an ink jet recording apparatus of the kind, there may be generated ink mists formed by fine secondary ink droplets in addition to the main droplets flying to the recording material when ink droplets are discharged from each of the discharge ports for recording and others. Then these ink mists and the like, which do not reach the recording material, tend to fly and adhere to the discharge port surface of the recording means. These adhering ink droplets are combined and developed to create a "wet" on the discharge port surface. Then, when this "wet" contacts the discharge ports, the discharge direction of ink droplets (main droplets) from the discharge ports is caused to be bent, and may disturb the discharge itself eventually.

In order to prevent any defective discharges caused by a "wet" of the kind, it is practiced to provide a cleaning member (an elastic wiping member made of rubber to wipe off the wet, for example) to clean the discharge port surface, and a cap as well as a pump for the recovery system in order to suck ink from the discharge ports for cleaning off the ink which adheres to the vicinity of the discharge ports. In other words, with means for discharge recovery processes including the cleaning member, the cap, and the pump for the recovery system, it is practiced to clean and remove the adhering ink before the adhering ink droplets on the discharge port surface are caused to develop into the "wet".

However, the method to wipe off the discharge port surface by use of the cleaning member (wiping member) requires rubbing in the vicinity of the fine discharge ports. As a result, ink and dust particles are pressed into the discharge ports, hence clogging them or creating a possibility that the discharge port surface is damaged. Further, because of the cleaning operations, there may be a disadvantage that the throughput is unfavorably lowered. Also, the method to suck ink from the discharge ports by use of the cap and the pump for the recovery system may result in the disadvantage that the throughput is unfavorably lowered due to the suction recovery operations (cleaning operations) in addition to the disadvantage that the running cost becomes higher because of the wasteful ink consumption.

Therefore, it is a prerequisite to minimize the frequency of discharge recovery operations (cleaning operations). To this end, there have been many inventions proposed to reduce the frequency of cleaning operations (discharge recovery operations) by predicting the "wetting" conditions developed from the ink droplets adhering to the discharge port surface while monitoring the temperature of a recording head, the environmental temperatures, the number of recording dots, and the like.

Nevertheless, these inventions are not the ones which monitor the "wetting" conditions of the discharge port surface directly. On the other hand, the "wet" itself is easily affected by the contamination of the discharge port surface and the discharging stability of the discharge ports, making it extremely difficult to predict its conditions exactly. Inevitably, therefore, the frequency of the cleaning operations (discharge recovery operations) cannot be reduced sufficiently. It is the technical problems that must be solved in consideration of enhancing the reliability of the recording head and reducing the running cost of the apparatus.

SUMMARY OF THE INVENTION

The present invention is designed to solve these technical problems to be solved. It is an object of the invention to provide an ink jet recording apparatus capable of suppressing the frequency of the cleaning operations of recording means to the minimum; reducing the ink consumption for the improvement of the throughput of the recording apparatus, at the same time, prolonging the life of the recording means; and maintaining a good recording quality at all times.

The invention according to Claim 1 hereof is an ink jet recording apparatus which records by discharging ink from recording means to a recording material. This apparatus comprises cleaning means for cleaning the discharge port surface of the aforesaid recording means, and an optical sensor for sensing the wetting conditions of the discharge port surface in accordance with the reflecting degree of the discharge port surface. Then the structure is arranged to operate the aforesaid cleaning means in response to the output of the optical sensor for the achievement of the object described above.

The inventions according to Claims 2 and 3 hereof are such that the aforesaid cleaning means is structured to be provided with a plurality of wiping members in addition to the structure arranged in accordance with Claim 1 hereof, so that such a plurality of wiping members can be used depending on the output of the aforesaid optical sensor or the aforesaid recording means is provided with a plurality of discharge port groups which discharge a plurality of different kinds of ink in response to the output of the aforesaid optical sensor. With such structure, it is intended to achieve the object described above more efficiently.

DETAILED DESCRIPTION OF THE PREFERRED EMBODIMENTS

Figure 1:
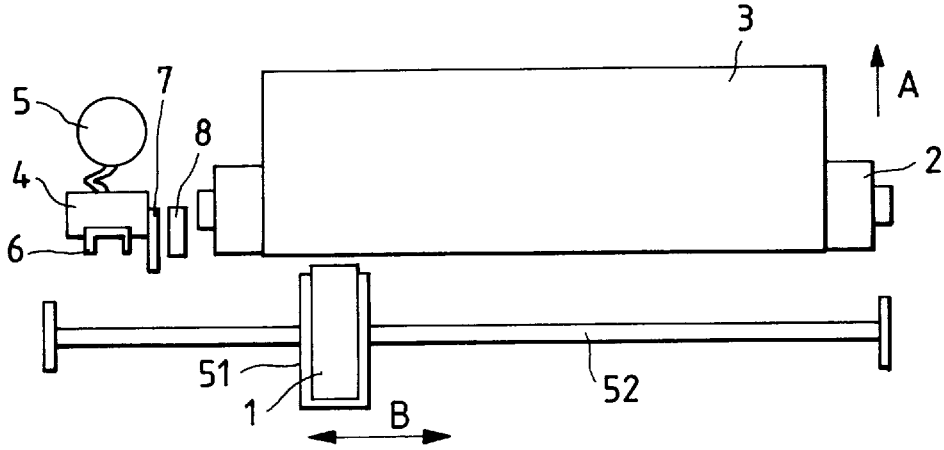
FIG. 1 is a plan view schematically showing a first embodiment of an ink jet recording apparatus to which the present invention is applicable.

Hereinafter, with reference to the accompanying drawings, the description will be made of the embodiments in accordance with the present invention. In this respect, the same reference marks designate the same or corresponding elements throughout each of the drawings. FIG. 1 is a plan view which schematically shows a first embodiment of an ink jet recording apparatus to which the present invention is applicable. In FIG. 1, reference numeral 1 designates recording means (recording head) of an ink jet type which records by discharging ink; 2, a platen which dually functions as sheet feeding (feeding) means; 3, a recording material (recording medium) of a sheet type such as a recording sheet; 4, a discharge recovery processing unit for maintaining the ink discharge performance of the recording head 1 in a good condition and recovering it thereto; 5, a pump for sucking ink from the discharge ports of the recording head 1; 6, a cap for airtightly closing the discharge ports by being in close contact with the discharge port surface of the recording head 1; 7, a wiping member for cleaning by wiping off the discharge port surface of the recording head 1; and 8, an optical sensor for determining the "wetting" condition of the ink adhering to the discharge port surface of the recording head 1.

In FIG. 1, the aforesaid recording head 1 is mounted on a carriage 51. The carriage 51 is supported and guided to reciprocate (main scan) along the guide rail 52 which is arranged in parallel with the platen roller 2. Here, it may be possible to arrange the structure so that the recording head 1 can be supported and guided to reciprocate directly on the guide rail 52 without the use of the carriage 51. The recording material 3 can be fed (sub scanned) in the direction indicated by an arrow A by rotating the platen roller 2 by means of a feed motor (not shown). Also, a carriage motor (not shown) drives the carriage 51 to reciprocate in the direction indicated by arrows B (in the main scanning direction) through a timing belt.

In FIG. 1, the interior of the cap 6 is connected to the pump 5. The wiping member 7 is formed by a rubbery elastic flat element.

Figure 2:
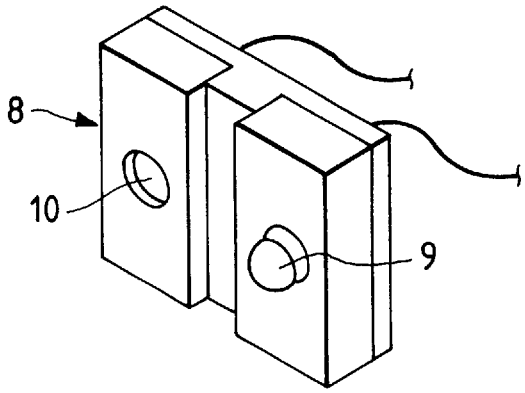
FIG. 2 is a perspective view schematically showing the structure of an optical sensor represented in FIG. 1.

FIG. 2 is a perspective view which schematically shows the brief structure of the optical sensor 8 represented in FIG. 1. The optical sensor 8 is formed by a pair of a light emitting element 9 and a light detector element 10 and structured to sense the degree (condition) of the "wet" of the discharge port surface in accordance with the luminous energy of reflection from the discharge port surface by projecting light onto it, and at the same time, measure the luminous energy of reflection therefrom. The signal of such detection is inputted into a controller of the recording apparatus.

Figure 3:
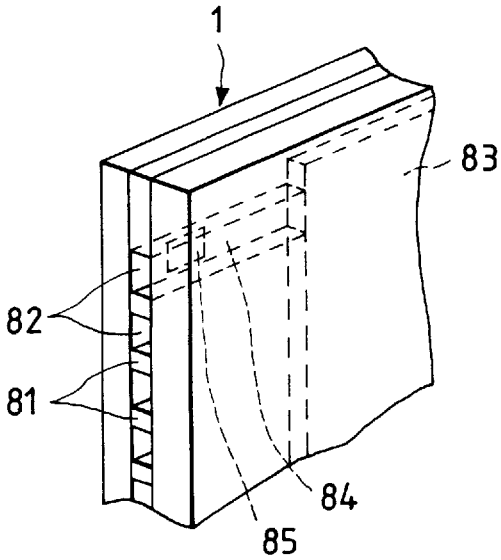
FIG. 3 is a partially perspective view which schematically shows the structure of an ink discharge unit of recording means represented in FIG. 1.

FIG. 3 is a partially perspective view which schematically shows the structure of the ink discharge unit of the recording head 1. The aforesaid recording means (recording head) 1 is an ink jet recording means for discharging ink by utilization of thermal energy, and is provided with electrothermal transducing elements for generating thermal energy. Also, the aforesaid recording head 1 records by discharging ink from its discharge ports by utilization of changes in pressure to be created by the development and contraction of air bubbles due to film boiling generated by the thermal energy to be applied by the aforesaid electrothermal transducing elements. In FIG. 3, a plurality of discharge ports 82 are formed at predetermined pitches on the discharge port surface 81 which faces the recording material 3 at a predetermined gap of (approximately 0.5 to 2.0 mm, for example), and then, along the wall faces of each liquid path 84 which is conductively connected to the common liquid chamber 83 and each of the discharge ports 82, the electrothermal transducing elements (heat generating resistive elements or the like) 85 are arranged to generate the energy to be used for ink discharge. In the present embodiment, the recording head 1 is mounted on the carriage 51 in such a position that the aforesaid plural discharge ports 82 are arranged in the direction intersecting the traveling direction (main scanning direction) of the carriage 51. In this way, the electrothermal transducing elements 85 are driven (energized) in response to the image signals or discharge signals, hence arranging the recording means 1 to enable ink in each liquid path 84 to provide film boiling for discharging the ink from the respective discharge ports 82 by the application of the pressure thus generated at that time.

Figure 4:
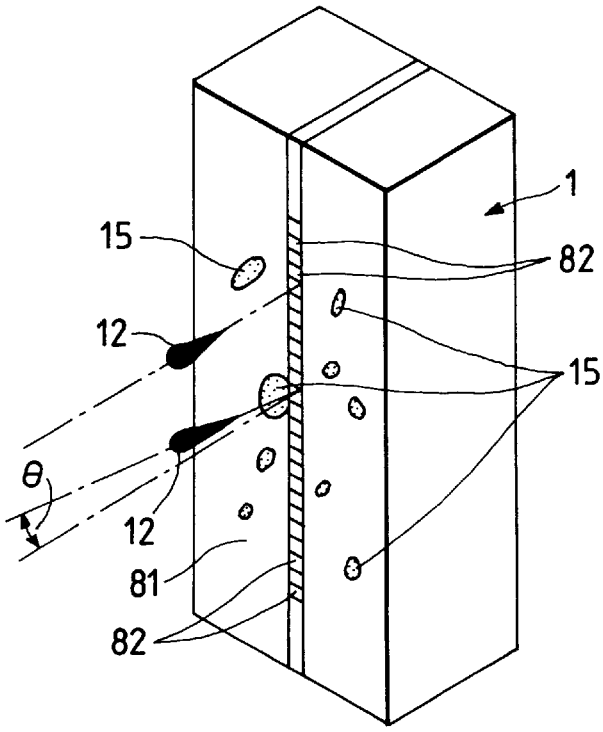
FIG. 4 is a perspective view which schematically shows the relationship between the wet on the discharge port surface of recording means and the disturbance of discharge.

In an ink jet recording apparatus, the mist-like ink, which does not reach the recording material 3, adheres to the discharge port surface 81, resulting in the "wet" to be created on the discharge port surface 81 when the recording head 1 is continuously used for recording. This "wet" is caused to develop gradually as the recording is continuously made. FIG. 4 is a perspective view which schematically shows the recording head 1 where the "wet" of ink is generated on its discharge port surface 81. When the developed "wet" (adhering ink droplets) 15 contacts the discharge ports 82 as shown in FIG. 4, the discharging direction of the ink droplets (flying ink droplets) 12 discharged from the discharge ports is deviated by an angle of θ. Due to this deviation of the discharging direction, the impact positions (recording dots) of ink droplets 12 on the recording material 13 are caused to be displaced, thus degrading the recording quality. In such a case, the discharge port surface 81 is covered by many ink droplets 15 as shown in FIG. 4.

Figure 5:
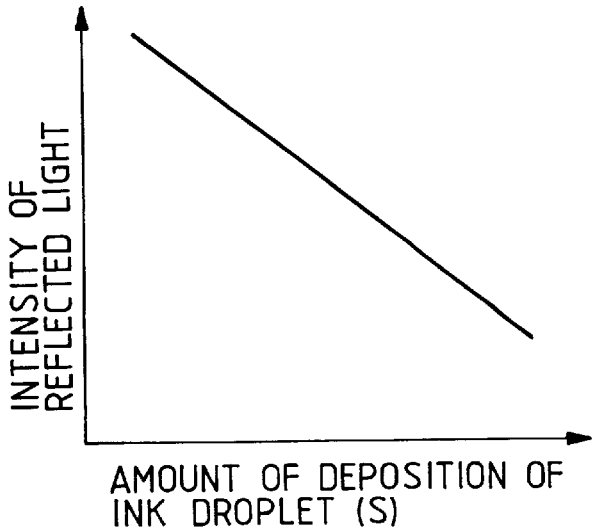
FIG. 5 is a view which shows the relationship between the wet on the discharge port surface of recording means and the intensity of reflected light.

In general, the discharge port surface 81 of a recording head 1 is formed by polysulfone, epoxy resin, or some other synthetic resin, a silicon substrate, or a nickel-plated board, having a high light reflectance. On the other hand, the light reflectance of ink is low because of its inclusion of color materials. FIG. 5 is a diagram which shows the general relationship between the amount of ink droplets adhering to the discharge port surface 81 and the intensity of reflected light (luminous energy) thereon. There is a characteristic tendency that the more the adhering amount of ink droplets is increased, the more the luminous energy of reflection is decreased. Therefore, when the optical sensor 8 senses the intensity of reflected light of the discharge port surface 81, the intensity of reflected light from the discharge port surface 81 is decreased as the adhering amount of the ink droplets is increased. The output level of the aforesaid light detector element 10 is also lowered accordingly.

As a result, when operating a recording, it is possible to detect the "wetting" condition of the discharge port surface 81 exactly on real time by sensing the intensity of reflected light (the luminous energy of reflection) with the sensor 8 per line or every several lines of recording scans. It is preferable to sense the intensity of reflected light per line as the required detection timing because, in this way, an appropriate measure can be taken reliably for any unexpected situation. In practice, however, it may be possible to arrange a timing so that the detection is made per every five lines or it is made three to five times per page because the adhering amount of ink droplets is not so great as to require the detection per line. With a detection of the kind, the discharge recovery processing unit 4 can be actuated to wash off the deposited ink droplets or wipe them off immediately before the "wet" becomes such as to affect the intended ink discharges. In this way, recording can be performed in a good condition at all times, while making it possible to suppress the frequency of use of the discharge recovery processing unit 4 to the minimum (to minimize its operation). The amount of ink consumption can be minimized while enhancing the reliability of the recording head 1. The throughput of the recording apparatus can also be improved among other significant effects which are practically obtainable.

The optical sensor 8 may be arranged by combining the LED (light emitting diode) 9 and the light detector element 10 or by the combination of any other known elements without the provision of any structure that may be required particularly. In this respect, as a method for sensing the "wet" on the discharge port surface 81, it is conceivable to incorporate a moisture sensor or a sensor for dew condensation in the recording head 1 or to incorporate a sensor for detecting the electrical conduction of the surface.

However, in order to introduce any one of these methods, it is required to modify the manufacturing processes of recording heads currently in use, thus making them more complicated. There is also another disadvantage that if these methods are implemented for the disposable ink cartridge formed integrally by a recording head and an ink tank, the cost of such head becomes inevitably high, thus the running cost becomes also high. On the contrary, the use of the optical sensor 8 described above does not produce any adverse effect on the manufacturing processes of the recording head 1 or its cost, and makes it possible to achieve the intended objective and functional effects.

In accordance with the first embodiment described in conjunction with FIG. 1 to FIG. 5, the structure is arranged so that the "wetting" condition is detected by measuring the intensity of reflected light of the discharge port surface 81 of the recording head 1 by use of the optical sensor 8, and then, the discharge recovering means (cleaning means), such as suction recovering means or wiping means, is controlled and actuated by controlling means. Therefore, it is possible to obtain an ink jet recording apparatus capable of suppressing the frequency of cleaning operations (discharge recovery operations) of the recording head 1 to the minimum; knowing the wear condition of the cleaning member; reducing the amount of ink consumption; improving the throughput of the recording apparatus; enhancing the reliability and durability of the recording head 1; and maintaining the good recording quality at all times.

Figure 6:
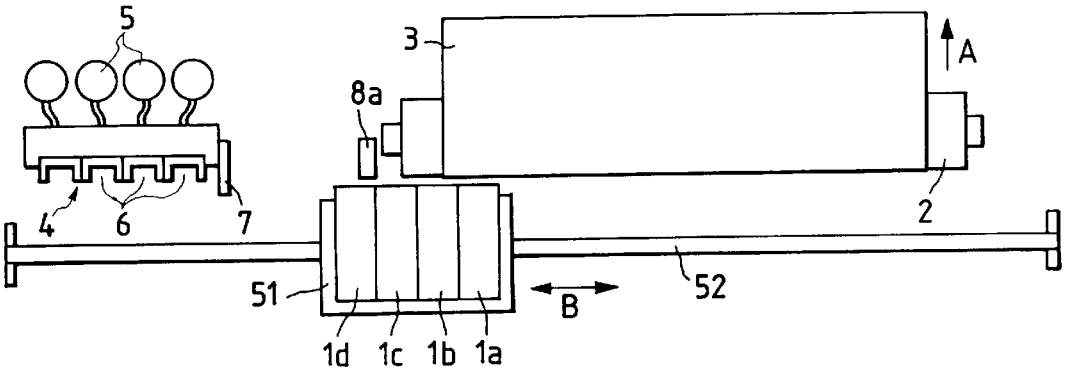
FIG. 6 is a plan view schematically showing a second embodiment of an ink jet recording apparatus to which the present invention is applicable.
Figure 7:
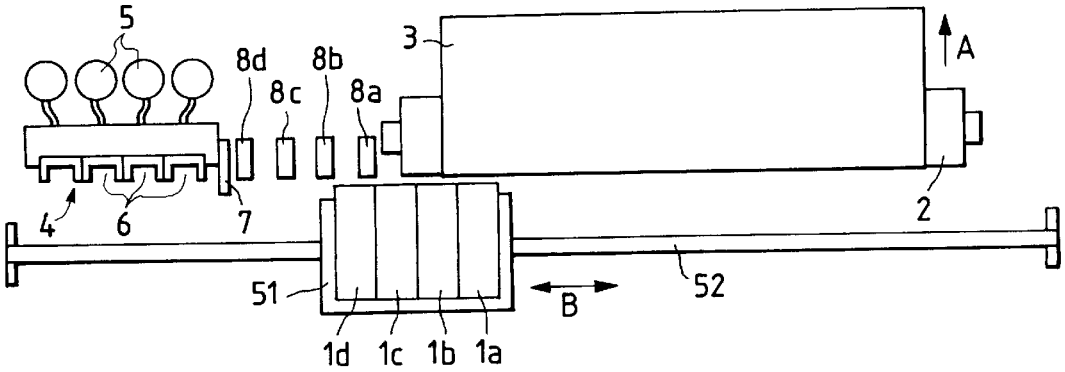
FIG. 7 is a plan view schematically showing a third embodiment of an ink jet recording apparatus to which the present invention is applicable.
Figure 8:
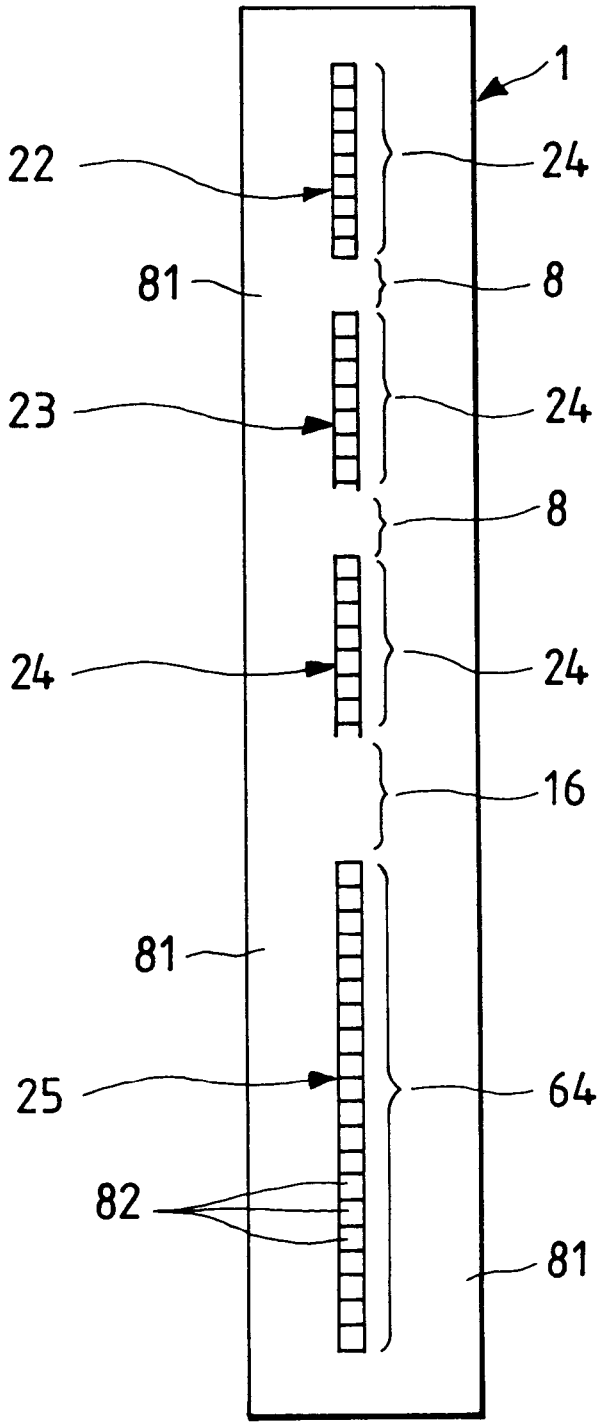
FIG. 8 is a plan view schematically showing a fourth embodiment of an ink jet recording apparatus to which the present invention is applicable.

Now, the description will be made of another embodiment of the present invention applicable to an ink jet recording apparatus for recording by use of a plurality of different kinds of ink. For the cases where a plurality of different kinds of ink are used, there are recordings which use ink of different colors, and ink of the same color but different densities or the one which is made by combining these kinds of ink. FIG. 6 and FIG. 7 are plan views which schematically illustrate two structural examples of the color ink jet recording apparatus which use a plurality of recording heads for recording in different colors. FIG. 8 is a front view which schematically illustrates the color recording head for which a plurality of discharge port groups are arranged on the discharge port surface of one recording head for recording in different colors.

In other words, as a method for recording in color, there is one as shown in FIG. 6 and FIG. 7 that plural recording heads (four) 1*a,* 1*b,* 1*c,* and 1*d* for recording in black (Bk), cyan (C), magenta (M), and yellow (Y) are arranged in the direction in which the recording heads travel (the traveling direction of the carriage) or the one as shown in FIG. 8 in which the discharge ports 82 on the discharge port surface of the one recording head 1 are divided into plural (four) discharge port groups 22, 23, 24, and 25, and then, different kinds of ink are supplied to each of the discharge port groups. In this respect, as shown in FIG. 8, the plural discharge port groups 22, 23, 24, and 25 are arranged in the direction rectangular to the traveling direction of the recording head 1 (carriage 51).

In either of the aforesaid methods where a plurality of recording heads are used and one recording head is divided into a plurality of discharge port groups, recording is performed individually by each of the discharge port groups when it is made in color. Consequently, the "wetting" conditions in the vicinity of discharge ports 82 differ from each other depending on the respective discharge port groups. The same is applicable to the case where ink of different property is used for each of the discharge port groups. As a result, it is necessary to remove the "wet" on each of the discharge prot groups in an appropriate timing, respectively, in order to save the ink consumption, improve the throughput, and enhance the reliability of the recording heads, while maintaining a good recording quality. To this end, it is required to measure the "wet" on each of the discharge port groups independent of each other.

Now, the description will be made of a second embodiment of the present invention with reference to an ink jet recording apparatus represented in FIG. 6. In the present embodiment, one optical sensor 8 is arranged, and when the four recording heads 1*a*, 1*b*, 1*c*, and 1*d* pass in front of the sensor 8 one after another, the luminous energy of reflection (intensity of reflected light) of the discharge port surface 81 of each recording head is read thereby. The relationship between the adhering amount of ink to each of the recording heads and the luminous energy of reflection differs from each other depending on the kinds of ink (colors, properties, and others thereof). Therefore, the level which is set separately for each kind of ink and the luminous energy of reflection from each recording head are compared to determine whether or not cleaning is required per recording head.

Then, only for the recording head for which a cleaning is needed, the discharge port surface thereof is cleaned (discharge recovery process is performed). Therefore, in accordance with the present embodiment, it is possible to obtain an ink jet recording apparatus capable of suppressing the frequency of the cleaning operations (discharge recovery operation) of each recording head to the minimum; knowing the wear condition of the cleaning member; reducing the amount of ink consumption; improving the throughput of the recording apparatus; and enhancing the reliability and durability of each recording head, while maintaining a good recording quality at all times as in the case of the first embodiment.

FIG. 7 is a view which shows a third embodiment of an ink jet recording apparatus to which the present invention is applicable. In the present embodiment, plural (four) optical sensors 8*a*, 8*b*, 8*c*, and 8*d* are arranged for the plural (four) corresponding recording heads 1*a*, 1*b*, 1*c*, and 1*d* to measure (detect) the "wetting" condition per recording head by means of the sensor 8 dedicated thereto. In accordance with the structure represented in FIG. 7, it is possible to increase the effective sensitivity by use of a predetermined color filter corresponding to the color of ink per optical sensor more than the case where a single optical sensor is used as described in conjunction with FIG. 6. This increase of the effective sensitivity is possible in addition to the same effects obtainable in each of the previous embodiments.

Now, with reference to FIG. 8, and FIG. 9 to FIG. 11, the description will be made of a fourth embodiment in accordance with the present invention. In the present embodiment, although the recording head which is used is only one, the discharge port surface 81 of the recording head 1 is divided into plural (four) discharge port groups for recording in different kinds of ink (different ink in colors and properties), and then, different kinds of ink are supplied to each of the discharge port groups. In FIG. 8, there are arranged on the discharge port surface 81, the discharge port group 22 which discharges yellow ink, the discharge port group 23 which discharge magenta ink, the discharge port group 24 which discharge cyan ink, and the discharge port group 25 which discharge black ink in that order from the top.

In each of the discharge port groups 22 to 25, the yellow, magenta, and cyan discharge port groups are structured with 24 discharge ports (24 dots) each, while the black discharge port group is structured with 64 discharge ports (64 dots). Then, each of the discharge port groups is set apart from each other at intervals equivalent to 8 discharge ports to 16 discharge ports. Now, when using the recording head represented in FIG. 8, each optical sensor 8 is arranged in the four positions in the vertical direction facing each of the discharge port groups 22 to 25. Thus it is possible to detect (measure) the "wet" on each of the discharge port groups individually and to clean (to process the discharge recovery on) each area of the discharge port groups at a desired timing, respectively.

Figure 9:
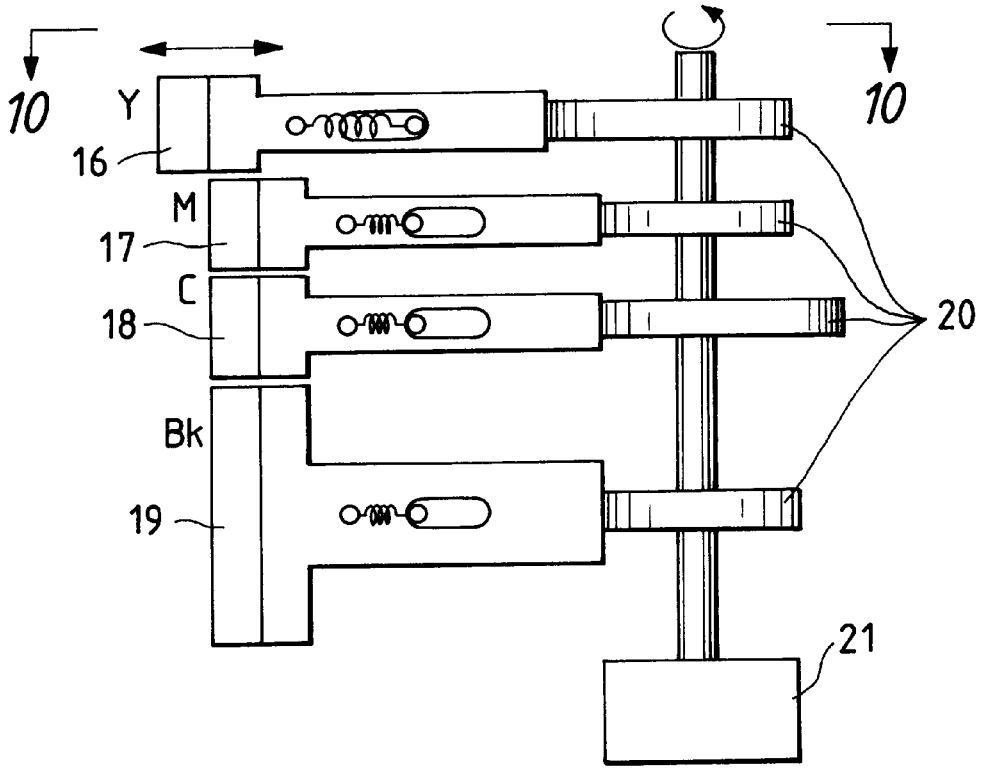
FIG. 9 is a side view which schematically shows a structural example of cleaning means to be used for recording means represented in FIG. 8.
Figure 10:
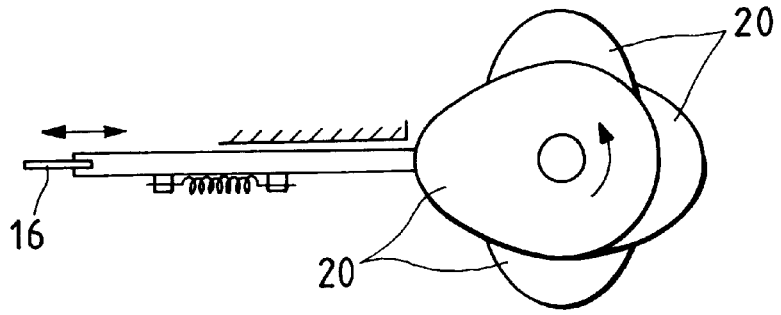
FIG. 10 is a schematic plan view taken along line 10—10 in FIG. 9.

Also, when using the recording head represent in FIG. 8, it may be possible to use one optical sensor having the CCDs which are arranged at substantially the same pitches as the pitches of the discharge port arrangements of each discharge port group, instead of using the four optical sensors. The advantage of an optical sensor of the kind is that by use thereof it becomes possible to sense the condition where the "wetting" takes place extremely locally due to uneven water repellency on the discharge port surface. FIG. 9 is a side view which schematically shows one example of cleaning means to be used for the recording head represented in FIG. 8. FIG. 10 is a view taken along line 10—10 in FIG. 9. The cleaning means shown in FIG. 9 and FIG. 10 is structured to be driven by one motor 21 to enable the wiping members 16 to 19 to move forward and backward between the extruded position (cleaning position) and the retracted position in order to clean each of the discharge port groups 22 to 25. The width (the length in the vertical direction) of the wiping member to be used for each of the discharge port groups (each ink color) is substantially equal to the width (the length in the vertical direction) of the corresponding discharge port group, and the structure is arranged so that the discharge port group for each color 22 to 25 can be cleaned independently.

Figure 11:
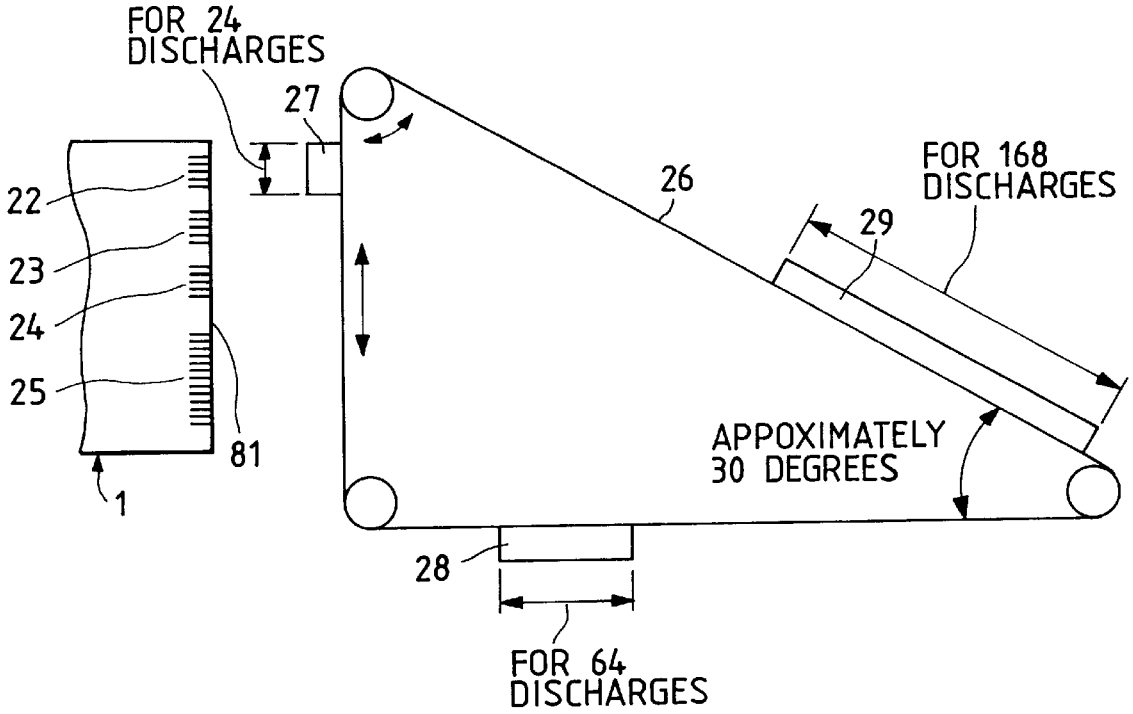
FIG. 11 is a side view which schematically shows another structural example of cleaning means to be used for recording means shown in FIG. 8.

The cleaning means represented in FIG. 9 and FIG. 10 is structured to interlock each of the wiping members 16 to 19, but instead of this arrangement, it may be possible to arrange the structure so that only one color can be cleaned or the discharge port groups of two to four colors (entire colors) can be cleaned at a time by selectively using the plural wiping members having different widths (lengths in the vertical direction). FIG. 11 is a schematic side view which shows the cleaning means which is so structured as to selectively use a plurality of wiping members having different lengths as described above.

In FIG. 11, there are arranged plural (three) wiping members 27, 28, and 29 having different widths (lengths) on a belt 26 tensioned around the three rollers as shown in FIG. 11. When the belt 26 travels (rotates), the wiping members are caused to travel. The first wiping member 27 has a length equivalent to 24 discharge ports (24 dots). This member is used for cleaning the discharge port groups 22 to 24, structured by 24 discharge ports, for yellow, magenta, or cyan, or a part of discharge port group 25 for black which is structured by 64 discharge ports.

The second wiping member 28 has a length equivalent to 64 discharge ports (64 dots). It is used for cleaning the discharge port group 25 for black which is structured by 64 discharge ports. Further, the third wiping member 29 has a length equivalent to 168 discharge ports (168 dots). It is used for cleaning the entire discharge port groups 22 to 25 for yellow, magenta, cyan, and black at a time. The cleaning means represented in FIG. 11 has a lesser number of parts than the one represented in FIG. 9 and FIG. 10, and is characterized in that its structure is simple.

Figure 12:
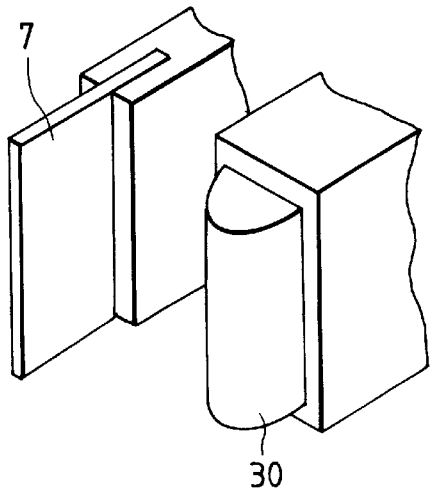
FIG. 12 is a perspective view which schematically shows cleaning means to be used for a fifth embodiment according to the present invention.
Figure 13:
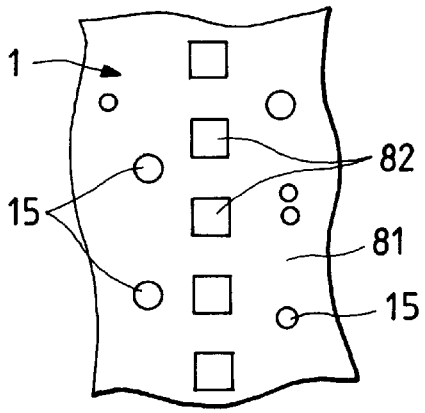
FIG. 13 is a partially front view schematically showing a wetting condition on the discharge port surface having a high water repellency.
Figure 14:
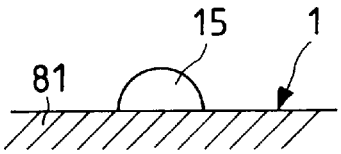
FIG. 14 is a cross-sectional view schematically showing the portion where ink droplets adhere in FIG. 13.

Now, the present invention will be described in accordance with a fifth embodiment. The present embodiment relates to an ink jet recording apparatus which uses two kinds of cleaning members as shown in FIG. 12. In other words, the apparatus uses a wiping member (blade) 7 formed by a rubbery elastic element, and a mopping member 30 which is an ink absorbent. The discharge port surface 81 of the recording head 1 is usually made by a material having a high water repellency so that adhering ink droplets can be removed easily. When the discharge port surface 81 has a high water repellency, it is possible to remove them easily by the wiping member 7, liquid cleaning, and the like because as shown in FIG. 13 and FIG. 14, the contacting angle between the adhering ink droplets 15 and the discharge port surface 81 is great.

Figure 15:
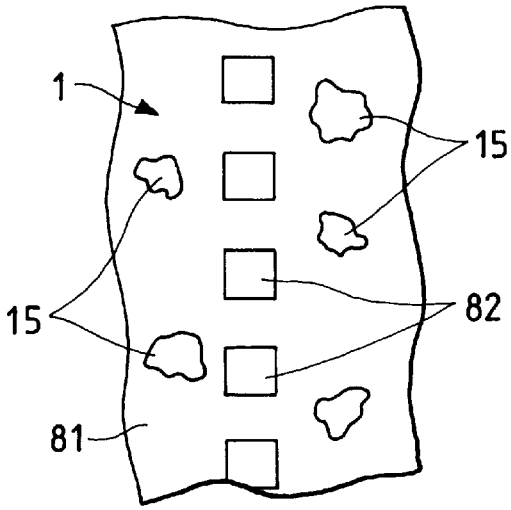
FIG. 15 is a partially front view schematically showing a wetting condition on the discharge port surface having a low water repellency.
Figure 16:
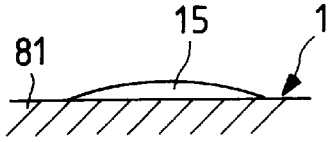
FIG. 16 is a cross-sectional view schematically showing the portion where ink droplets adhere in FIG. 15.

However, as the time elapses, the water repellency of the discharge port surface 81 is lowered due to the fact that the ink remaining after mopping is caused to dry, and also, dust particles in the air adhere thereto among others. When the water repellency is lowered, the contacting angle between the adhering ink droplets 15 and the discharge port surface 81 becomes small as shown in FIG. 15 and FIG. 16, making it difficult to remove the ink droplets 15. Further, the discharge port surface 81 develops its "wetting habit", hence necessitating more frequent cleaning operations. In order to prevent these events from taking place, there has been proposed the maintenance of the water repellency by rubbing off the stains from the discharge port surface 81 by use of the second cleaning member 30. As a second cleaning member 30, a urethane sponge has been proposed, for example.

However, it is adopted to press the sponge 30 onto the discharge port surface 81 and move it to the left and right in order to rub off the stains therefrom. As a result, there is a high probability that the discharge port surface 81 is damaged, and it is desirable to suppress the cleaning operation by use of this sponge 30 to the least possible frequency required. Nevertheless, there has been provided no means for sensing the lowered water repellency of the discharge port surface 81 for the conventional ink jet recording apparatuses. Therefore, the rubbing off (mopping) operation described above is performed at predetermined intervals periodically, thus hindering the intended prolongation of the life of the recording head 1. Now, therefore, the present embodiment is structured to minimize the frequency of the mopping operations by application of the present invention.

Figure 17:
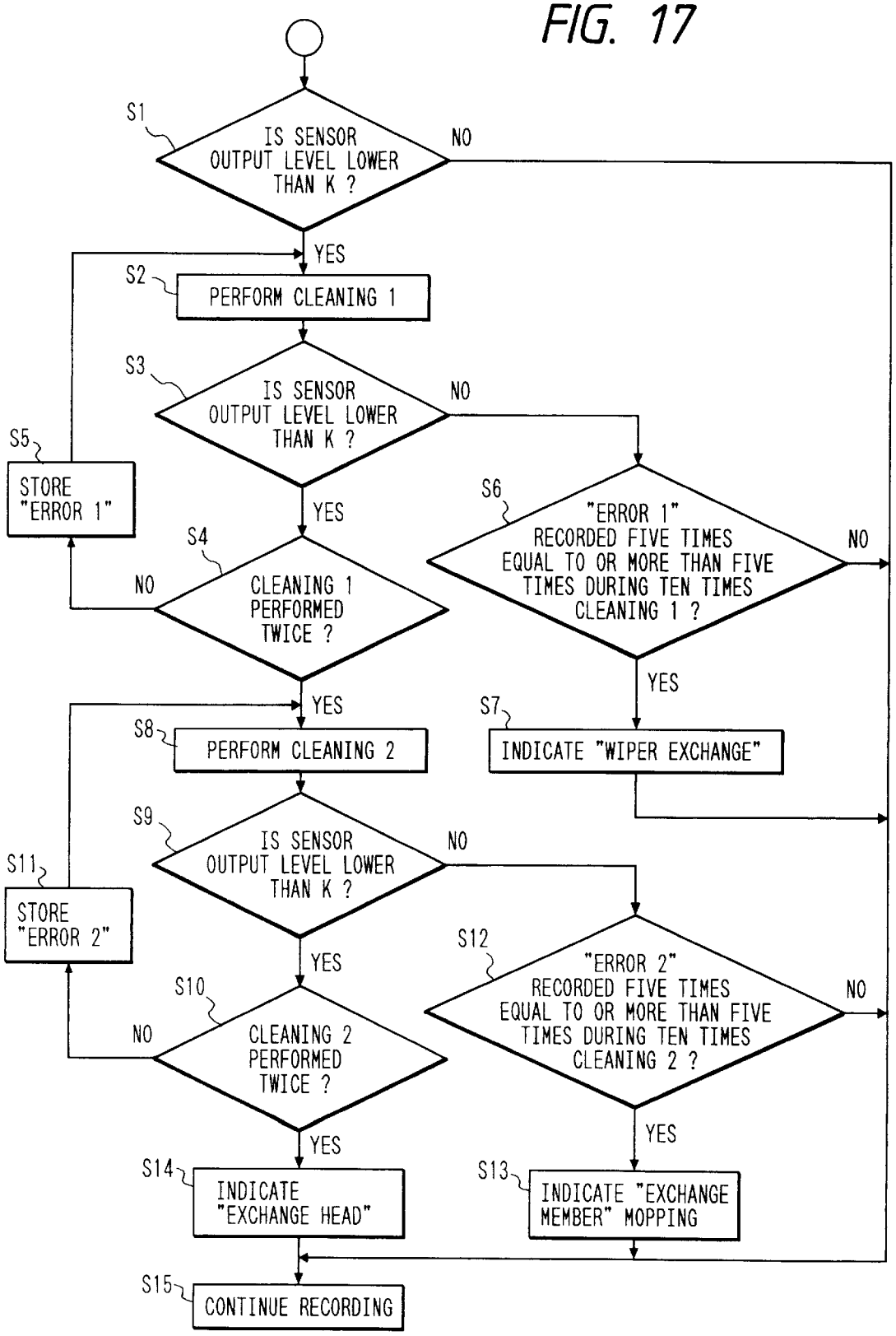
FIG. 17 is a flowchart which shows the sequence of cleaning operation for an ink jet recording apparatus in accordance with the fifth embodiment of the present invention.

FIG. 17 is a flowchart showing the characteristic operation of the present embodiment (fifth embodiment). In FIG. 17, the output level is determined (step S1) when the recording head 1 and the optical sensor 8 face each other. If the output level is found to be more than "K", it is interpreted that the "wet" is in a small state, thus continuing the recording (step S15). If the level is found to be less than "K", it is interpreted that the "wet" is in a large state. Then, in step S2, "cleaning 1" is performed. This "cleaning 1" is an operation to remove the ink droplets 15 by wiping off the discharge port surface 81 by use of the wiping member (wiper) 7 formed by a rubbery elastic element, for example. After that, the output of the optical sensor 8 is observed (step S3). If the output level is still lower than "K", the "cleaning 1" is again performed (step S4), and then, "error 1" is stored (step S5).

In FIG. 17, the output level is more than "K" in the step S3, the recording is continued, but before this, it is confirmed (in step S6) that how many times the "error 1" has been stored in the past ten times of "cleaning 1". If it is confirmed that the "error 1" has been stored often, there is a doubt that the ink removal performance of the wiping member (wiper) 7 has been lowered. In practice, when a rubber wiping member (wiper) 7 is used, it is distinctly known that the ink removal performance thereof is lowered because of rubber being subjected to wear. If this wearing condition is left intact, not only the throughput is delayed, but also, the dust particles from the worn rubber cause the discharge ports 82 to be clogged, leading to the troubles (defective discharges and the like).

Now, for example, if the "error 1" has been stored five times in the past ten-time "cleaning 1", a message is displayed in step S7 to the effect that "the wiper should be exchanged". If the output level of the sensor is found to be less than "K" even after the "cleaning 1" has been conducted twice, there is a high probability that the water repellency of the discharge port surface 81 becomes lowered as shown in FIG. 15 and FIG. 16. In this case, therefore, "cleaning 2" is performed (step S8). This "cleaning 2" is an operation to mop off the stains on the discharge port surface 81 by use of the urethane sponge 30, for example.

After the "cleaning 2" has been operated, the sensor output is again observed (step S9). Then, if the level is still less than "K", the "cleaning 2" is again performed, and the "error 2" is stored (step S10 and step S11). The urethane sponge 30 is also subjected to wear as in the rubber wiper (wiping member) 7, and then, its mopping performance is lowered to create the dust particles therefrom. Therefore, if the "error 2" is often stored, a message is displayed to the effect that "the mopping member should be exchanged" (step S12 and step S13).

If the output level of the sensor 8 is still less than "K" even after the "cleaning 2" has been performed twice, it can be considered that the recording head 1 is damaged by some causes, and it cannot be recovered. Therefore, a message is displayed to the effect that "the head should be exchanged" (step S14). As described above, in accordance with the present embodiment (fifth embodiment), not only it is possible to know the lowered water repellency of the discharge port surface 81 in addition to the same effects obtainable as in the case of the aforesaid first embodiment, but also, it is possible to know the timing for the rubber wiper (wiping member) 7, the urethane sponge (mopping member) 30, as well as the recording head 1 to be exchanged unlike in the conventional art. Hence, a good recording quality can be maintained at all times. Particularly, it is possible to obtain a significant effect when using a hot-melting ink which tends to be solidified on the discharge port surface 81.

Here, in accordance with each of the aforesaid embodiments, the description has been made while exemplifying a serial recording type where recording means (recording head) travels in the main scanning direction, but the present invention is also applicable equally to a line recording type where recording is made only by subscanning with line recording means having a length to cover the entire width of a recording material totally or partially. It is also possible to obtain the same effects. Further, the present invention is equally applicable to a color recording apparatus using a plurality of recording means for recording in different colors, or to a tonal recording apparatus using a plurality of recording means for recording in the same color but different densities, or to a recording apparatus in which these are combined, and the same effects can be obtained.

Moreover, the present invention is equally applicable to any of the structural arrangements of the recording head and ink tank, such as using an exchangeable head cartridge where the recording head and ink tank are integrally formed or providing the recording head and ink tank separately and connecting them with an ink supply tube, or the like, and the same effects can be obtained.

In this respect, the present invention is applicable to an ink jet recording apparatus which, for example, uses recording means (recording head) provided with piezoelectric elements or some other electro-mechanical transducing elements, but, particularly, the present invention can demonstrate excellent effects for an ink jet recording apparatus which uses recording means of a type where ink is discharged by utilizing thermal energy, because, with a type of the kind, it is possible to attain a highly densified recording in a high precision.

Furthermore, as the mode of ink jet recording apparatus according to the present invention, it may be possible to adopt among others the mode of a copying apparatus in which a leader and others are combined, and, further, the mode of a facsimile apparatus having transmitting and receiving functions in addition to those which can be used as an image output terminal for information processing equipment such as a computer.

As clear from the above descriptions, in accordance with an invention in Claim 1 hereof, an ink jet recording apparatus for recording by discharging ink from recording means to a recording material is provided with cleaning means for cleaning the discharge port surface of recording means, and an optical sensor for detecting the wetting condition on the discharge port surface in accordance with the degree of reflection from the discharge port surface. Then the structure is arranged to actuate the aforesaid cleaning means in accordance with the output of the aforesaid sensor, making it possible to provide an ink jet recording apparatus capable of suppressing the frequency of cleaning operations for recording means to the minimum; reducing the amount of ink consumption; improving the throughput of the recording apparatus; prolonging the life of recording means; and maintaining a good recording quality at all times.

In accordance with inventions in Claim 2 and Claim 3 hereof, the aforesaid cleaning means is provided with a plurality of wiping members in addition to the structure described in claim 1 hereof, and the structure is arranged to selectively use the aforesaid plural wiping members in response to the output of the optical sensor or it is arranged to provide aforesaid recording means with a plurality of discharge port groups for discharging a plurality of different kinds of ink, and then, the different discharge port groups are cleaned in accordance with the output of the aforesaid optical sensor. In this way, it is possible to provide an ink jet recording apparatus capable of minimizing the frequency of cleaning operation for recording means more efficiently; reducing the amount of ink consumption; improving the throughput of the recording apparatus; prolonging the life of recording means; and maintaining a good recording quality at all times.

What is claimed is:

1. A method for operating an ink jet recording apparatus having an optical sensor for detecting a degree of wetness of a discharge port surface and outputting an output in accordance with said degree of wetness of said discharge port surface, the ink jet apparatus provided with a discharge port for discharging ink, a first wiper including a rubber-like elastic member for wiping said discharge port surface, and a second wiper including an ink absorbing member for wiping said discharge port surface, said method comprising:

a first cleaning step of wiping said discharge port surface using said first wiper when the output of said optical sensor is less than a predetermined level; and a second cleaning step of wiping said discharge port surface using said second wiper when the output of said optical sensor is less than the predetermined level after said first cleaning step.

2. A method for operating an ink jet recording apparatus according to claim 1, further comprising the step of:

detecting a wetting condition on said discharge port surface based on the output of said optical sensor in accordance with the reflection rate of said discharge port surface before said first cleaning step, after said first cleaning step and after said second cleaning step, and wherein said first cleaning step and said second cleaning step each further comprise controlling said wiping in response to the output of said optical sensor.

3. A cleaning method for operating an ink jet recording apparatus according to claim 2, wherein said first cleaning step and second cleaning step are performed by a plurality of cleaning members, and said plurality of cleaning members are used selectively in said first cleaning step in response to the output of said optical sensor and in said second cleaning step in response to the output of said optical sensor.

4. A method for operating an ink jet recording apparatus according to claim 3, wherein said ink jet recording apparatus includes a plurality of recording heads, and said plurality of cleaning members correspond independently to each of the plural heads.

5. A method for operating an ink jet recording apparatus according to claim 3, wherein said plurality of cleaning members correspond to each of the discharge ports of one head having discharge ports arranged for discharging plural kinds of ink.

6. A method for operating an ink jet recording apparatus according to claim 3, wherein said recording apparatus is provided with a plurality of discharge port groups for discharging a plurality of different kinds of ink, and the different discharge port groups are cleaned in said first cleaning step in response to the output of said optical sensor and in said second cleaning step in response to the output of said optical sensor.

7. A method for operating an ink jet recording apparatus according to claim 3, wherein said recording apparatus is provided with electrothermal transducing elements for generating thermal energy utilized for discharging ink.

8. A method for operating an ink jet recording apparatus according to claim 2, wherein said recording apparatus is provided with a plurality of discharge port groups for discharging a plurality of different kinds of ink, and the different discharge port groups are cleaned in said first cleaning step in response to the output of said optical sensor and in said second cleaning step in response to the output of said optical sensor.

9. A method for operating an ink jet recording apparatus according to claim 3, wherein said plurality of discharge port groups are divided into a plurality of heads, and a plurality of said optical sensors are provided for said heads, respectively.

10. A method for operating an ink jet recording apparatus according to claim 8, wherein said plurality of discharge port groups are arranged on one head, and one optical sensor is arranged corresponding to said head, said sensor having CCD elements capable of monitoring the entire discharge port array.

11. A method for operating an ink jet recording apparatus according to claim 8, wherein said recording apparatus is provided with electrothermal transducing elements for generating thermal energy utilized for discharging ink.

12. A method for operating an ink jet recording apparatus according to claim 2, wherein said recording apparatus is provided with electrothermal transducing elements for generating thermal energy utilized for discharging ink.

13. A method for operating an ink jet recording apparatus according to claim 12, wherein said recording apparatus utilizes film boiling created in ink by thermal energy generated by said electrothermal transducing elements.

14. A method for operating an ink jet recording apparatus according to claim 2, wherein said optical sensor is a combination of light emitting element and light detector element.

15. A method for operating an ink jet recording apparatus according to claim 2, wherein said optical sensor has CCD elements.

16. A method for operating an ink jet recording apparatus having an optical sensor for detecting a degree of wetness of a discharge port surface and outputting an output in accordance with said degree of wetness of said discharge port surface, the ink jet apparatus provided with a discharge port for discharging ink, a first wiper including a rubber-like elastic member for wiping said discharge port surface, and a second wiper including an ink absorbing member for wiping said discharge port surface, said method comprising:

a first cleaning step of wiping said discharge port surface using said first wiper when the an output of said optical sensor is less than a predetermined level; and a second cleaning step of wiping said discharge port surface using said second wiper when the output of said optical sensor is less than the predetermined level after said first cleaning step.

17. A method for operating an ink jet recording apparatus according to claim 16, further comprising:

a display step of executing a display when the output of said optical sensor is less than the predetermined level after said second cleaning step is performed a predetermined number of times.

18. An ink jet recording apparatus for recording by discharging ink onto a recording material, the apparatus comprising:

a discharge port surface provided with a discharge port for discharging the ink;

cleaning means for cleaning the discharge port surface, said cleaning means being provided with a plurality of wiping members including a first wiping member and a second wiping member different from said first wiping member;

an optical sensor for detecting a wetting condition on said discharge port surface in accordance with a degree of reflection from said discharge port surface and outputting an output in accordance with the detected wetting condition; and controlling means for actuating said cleaning means in response to the output of said optical sensor, wherein said wiping members are used selectively in response to the output of said optical sensor.

19. An ink jet recording apparatus according to claim 18, wherein said discharge port surface is provided with a plurality of discharge port groups for discharging a plurality of different kinds of ink, and the different discharge port groups are cleaned in response to the output of said optical sensor.

20. An ink jet recording apparatus according to claim 19, wherein said plurality of discharge port groups are divided into a plurality of heads, and a plurality of said optical sensors are provided for said heads, respectively.

21. An ink jet recording apparatus according to claim 20, wherein said plurality of wiping members correspond independently to each of the plural heads.

22. An ink jet recording apparatus according to claim 19, wherein said plurality of discharge port groups are arranged in a discharge port array on one head, and one optical sensor is arranged corresponding to said head, said sensor having CCD elements capable of monitoring the entire discharge port array.

23. An ink jet recording apparatus according to claim 19, further comprising electrothermal transducing elements for generating thermal energy utilized for discharging the ink.

24. An ink jet recording apparatus according to claim 23, wherein said apparatus utilizes film boiling created in the ink by the thermal energy generated by said electrothermal transducing elements.

25. An ink jet recording apparatus according to claim 18, further comprising electrothermal transducing elements for generating thermal energy utilized for discharging the ink.

26. An ink jet recording apparatus according to claim 25, wherein said apparatus utilizes film boiling created in the ink by the thermal energy generated by said electrothermal transducing elements.

27. An ink jet recording apparatus according to claim 18, wherein said optical sensor is a combination of a light emitting element and a light detector element.

28. An ink jet recording apparatus according to claim 18, wherein said optical sensor has CCD elements.

29. An ink jet recording apparatus according to claim 28, wherein said CCD elements are arranged corresponding to the discharge ports.

30. An ink jet recording apparatus according to claim 18, wherein said plurality of wiping members correspond respectively to a plurality of discharge ports arranged for discharging plural kinds of ink.

31. An ink jet recording apparatus according to claim 18, wherein said discharge port surface is provided with a plurality of discharge port groups for discharging a plurality of different kinds of ink, and the different discharge port groups are cleaned in response to the output of said optical sensor.

32. An ink jet apparatus according to claim 18, wherein said optical sensor faces toward said discharge port surface during detection of the wetting condition.

33. An ink jet recording apparatus according to claim 18, wherein said first wiping member has a composition different from a composition of said second wiping member.

34. A method for operating an ink jet recording apparatus having a sensor for detecting a degree of wetness of a discharge port surface, the ink jet apparatus being provided with a discharge port for discharging ink, a first wiper for wiping said discharge port surface and a second wiper, different from said first wiper, for wiping said discharge port surface, said method comprising:

a first cleaning step of wiping said discharge port surface using said first wiper if the degree of wetness detected by said sensor is greater than a predetermined level; and a second cleaning step of wiping said discharge port surface using said second wiper if, after said first cleaning step, the degree of wetness detected by said sensor is greater than the predetermined level.

35. A method for operating an ink jet recording apparatus according to claim 34, wherein said recording apparatus is provided with a plurality of discharge port groups for discharging a plurality of different kinds of ink, and the different discharge port groups are cleaned in said first cleaning step in response to an output of said sensor and in said second cleaning step in response to the output of said sensor.

36. A method for operating an ink jet recording apparatus according to claim 35, wherein said plurality of discharge port groups are divided into a plurality of heads, and a plurality of said sensors are provided for said plurality of heads, respectively.

37. A method for operating an ink jet recording apparatus according to claim 35, wherein said plurality of discharge port groups are arranged on a head, and one sensor is arranged corresponding to said head, said sensor having CCD elements for monitoring the plurality of discharge port groups.

38. A method for operating an ink jet recording apparatus according to claim 34, wherein said recording apparatus is provided with electrothermal transducing elements for generating thermal energy utilized for discharging ink.

39. A method for operating an ink jet recording apparatus according to claim 38, wherein said recording apparatus utilizes film boiling created in ink by thermal energy generated by said electrothermal transducing elements.

40. A method for operating an ink jet recording apparatus according to claim 34, wherein said sensor is a combination of a light emitting element and a light detector element.

41. A method for operating an ink jet recording apparatus according to claim 34, wherein said sensor has CCD elements.

42. A method for operating an ink jet recording apparatus according to claim 41, wherein said CCD elements are arranged corresponding to the discharge ports.

43. A method for operating an ink jet recording apparatus according to claim 34, further comprising:

a display step of executing a display when an output of said sensor is less than the predetermined level after said second cleaning step is performed a predetermined number of times.

44. A method for operating an ink jet recording apparatus according to claim 34, wherein said sensor faces toward said discharge port surface during detection of the degree of wetness.

45. A method for operating an ink jet recording apparatus according to claim 34, wherein said first wiper has a composition different from a composition of said second wiper.

* * * * *

UNITED STATES PATENT AND TRADEMARK OFFICE

CERTIFICATE OF CORRECTION

PATENT NO. : 6,056,387
DATED : May 2, 2000
INVENTOR(S) : Kaneko

It is certified that error appears in the above-identified patent and that said Letters Patent is hereby corrected as shown below:

Title page,
Item [56], under U.S. PATENT DOCUMENTS, insert

| | | |
|---|---|---|
| -- 5,103,224 | 4/1992 | Gast et al. |
| 5,455,608 | 10/1995 | Stewart et al. |
| 5,530,462 | 6/1996 | Takahashi et al. -- |

Under FOREIGN PATENT DOCUMENTS, insert

| | | |
|---|---|---|
| -- 6-71904 | 3/1994 | Japan --. |

Column 13,
Line 37, "Claim 3" should read -- Claim 8 --; and

Columns 13 and 14,
Claim 16 should read:

-- 16. A method for operating an ink jet recording apparatus according to Claim 15, wherein said CCD elements are arranged corresponding to the discharge ports. --

Column 14,
Line 16, "Claim 16" should read -- Claim 1 --.

Signed and Sealed this

Second Day of April, 2002

*Attest:*

*Attesting Officer*

JAMES E. ROGAN
*Director of the United States Patent and Trademark Office*